United States Patent [19]

Catalano

[11] 4,289,189

[45] Sep. 15, 1981

[54] FOLDING GATE

[76] Inventor: Joseph Catalano, 2212 Beach Dr., Fox River Grove, Ill. 60021

[21] Appl. No.: 18,316

[22] Filed: Mar. 7, 1979

[51] Int. Cl.[3] ..... E06B 3/92

[52] U.S. Cl. ..... 160/160

[58] Field of Search ..... 160/159, 160, 161

[56] References Cited

U.S. PATENT DOCUMENTS 492,826 3/1893 Naylor et al. ..... 160/160

1,502,833 7/1924 Kitzelman ..... 160/160

3,285,323 11/1966 Catalano ..... 160/159

*Primary Examiner*—Peter M. Caun

*Attorney, Agent, or Firm*—Paul H. Gallagher

[57] ABSTRACT

A construction of mounting the web of a folding gate and incorporated in the gate, including a rail or bar mounted directly on a door jamb, and hinges having one leaf welded to the rail; one hinge has a round hole and the others have elongated slots pivotally receiving the rivets that secure the strips of the web together at the ends.

1 Claim, 8 Drawing Figures

FOLDING GATE

FIELD OF THE INVENTION

The invention resides in folding gates which include a web or mesh made up of strips pivotally secured together for extension and contraction of the web, and hence of the gate. As the web is extended and contracted, it is not only so extended and contracted in length, but correspondingly decreased and increased in height. It is desired that the web be maintained at a constant level at some particular location, usually the bottom but it can be for example the top or middle. The invention resides in construction and means for mounting a folding gate of the foregoing nature.

OBJECTS OF THE INVENTION

A broad object of the invention is to provide, in the field of folding gates of the character referred to above:

(a) simple construction for mounting the gate so as to maintain the gate, at one portion thereof, at a constant level notwithstanding the vertical movements of other portions thereof that are necessarily produced by the decrease and increase in height pursuant to extension and contraction of the gate;

(b) extremely simple construction for the purpose, which results in the complete elimination of one or two rails heretofore used;

(c) more specifically, hinges having slots therein, on which the web is mounted, the slots accommodating the necessary vertical movements of portions of the web referred to;

(d) such a construction wherein a single set of hinges can be utilized for any gate regardless of the portion of the gate to be maintained at a constant height, whether at the bottom, at the top, or therebetween, the particular accommodation being provided by positioning the individual hinges within a set.

DESCRIPTION OF A PREFERRED EMBODIMENT

Figure 1:
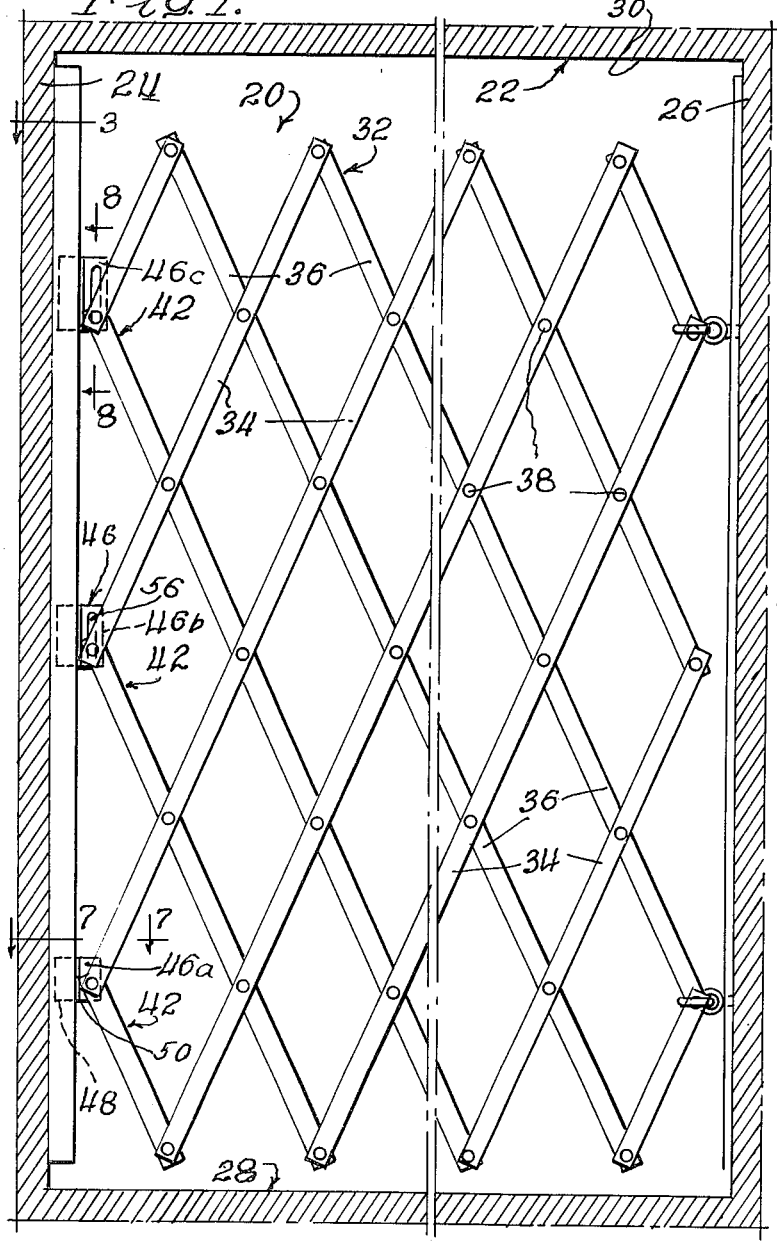
FIG. 1 is a face view of a folding gate made according to the present invention, showing the gate in extended or closing position for closing a doorway.

Referring in detail to the drawings, FIG. 1 shows a folding gate 20 embodying the features of the invention, mounted in a doorway 22 and in extended position closing the doorway. The doorway is defined at one side by a jamb 24 on which the folding gate is mounted as described in detail hereinbelow, and another jamb 26 to which the swinging edge or locking edge of the gate is secured when in closed position, also as described hereinbelow. FIG. 1 shows the floor or ground surface 28 and the top 30 of the doorway.

The folding gate 20 includes a web 32 usually so called in the trade, and also known as a mesh. The web 32 itself is of standard construction including two sets of strips 34, 36 those of each set being parallel and lying in a common plane, and the strips being fitted together with the planes in flat parallel relationship, and the strips in the two sets being at an angle to each other. The strips are pivotally connected together in the respective sets by means of rivets 38 preferably at all the points of intersection or crossing. This arrangement of the strips provides scallops or points 42 at the ends. The folding gate is extensible longitudinally, which is horizontally as represented in FIG. 1. The ends of the strips in the scallops 42 at the hinge end include rivets 44 which are longer than the rivets 38 for purposes of mounting the web to the hinges as explained hereinbelow.

A principal feature of the invention is incorporated in a plurality of hinges 46 individually identified 46*a*, 46*b*, 46*c*. These hinges are of conventional basic construction, each hinge including a pair of leaves, 48, 50 secured together by a pintle 52.

Figure 2:
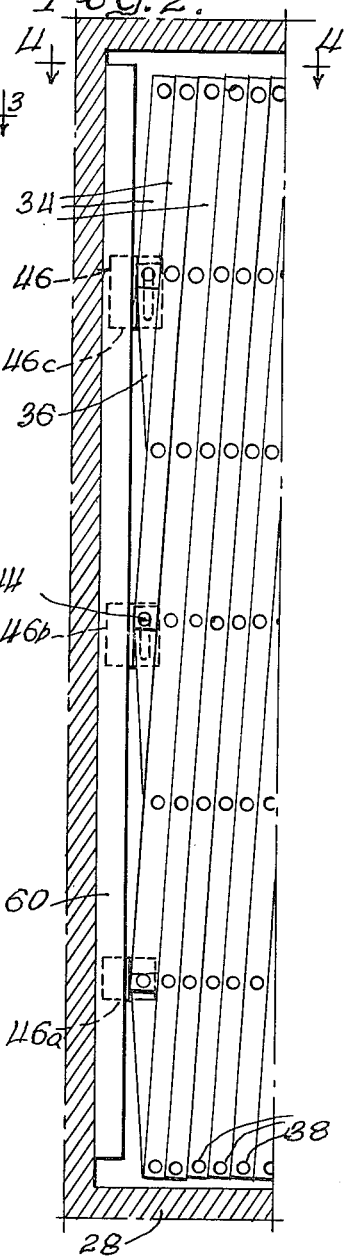
FIG. 2 shows the left half of the gate of FIG. 1 in open or contracted position.
Figure 6:
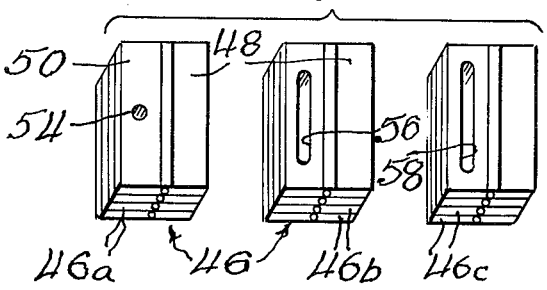
FIG. 6 is a view of the different kinds of hinges used on a single gate.

As is known, as the gate is extended and contracted longitudinally, it correspondingly decreases and increases in transverse direction (height) and it is desired that a certain portion thereof be maintained in a constant vertical position. For example, in the present case it is desired that the bottommost edge of the gate be maintained at a certain spacing from the floor, or at lease move a minimum amount relative thereto, while allowing the major portion of vertical movements to occur at the top. To this end the hinges are provided with holes or slots of different shapes and dimensions, as shown in FIGS. 1, 2 and 6. FIG. 6 shows three stacks of hinges 46, those in each stack being identical, and one of those from each stack forming a set for a gate, FIGS. 1 and 2. One of them 46*a*, has a round hole 54; the others, 46*b*, 46*c*, have vertically elongated slots 56, 58 which may be the same length, or the slot 56 may be shorter than the slot 58 as shown. These hole and slots are formed in the leaves 50 of the hinges. In the present arrangement, three hinges are utilized in one gate, this number representing the usual number of mounting points of a web, but more than that number may be utilized if desired.

The hinges are mounted to the web by inserting the long rivets 44 in the scallops 42 through the hole 54 and slots 56, 58. The hinges are mounted in fixed position on a rail (see below), and as the web is extended and contracted, the hole 54 holds the corresponding scallop stationary but the rivets in the slots 56, 58 are permitted to ride up and down, enabling vertical displacement of the upper portions of the web. FIG. 1 shows the rivets in the slots 56 and 58 adjacent the bottom of the slots in the extended position of the gate, and FIG. 2 shows them adjacent the top in the contracted position of the gate. That portion of the web longitudinally aligned with the hole 54 is held stationary, and the bottom-most edge moves vertically a small amount, because of the short length of the strips below the hole. If desired, the hinge 46*a* could be located at the lower-most position, and thus maintain the very bottom-most portion of the web stationary. It is also within the scope of the invention to place the hinge 46*a* at the middle or the top, instead. As will be understood, the greater the vertical distance from the hole 54, the greater will be the vertical movement, and hence the slot 58 may be longer, but the slot 56 may be as long as the slot 58 with the proper functioning. Also it may be desired to provide hinges of different lengths according to the vertical dimensions of the hole 54 and slots 56, 58 as shown in FIGS. 1 and 2, or all of the same length as shown in FIG. 6.

The hinges are secured to a rail 60 which takes the place of two rails heretofore used in folding gates, namely a mounting bar and a gate rail. In the present case the rail 60 is preferably an angle iron having one leg 62 for mounting directly to the door jamb and another leg 64 extending transversely or in the direction of the gate. The hinges 46 are secured to the leg 64 by welding the leaf 48 thereon as indicated at 66. In mounting the gate the rail 60 is then put in place by butting the leg 62 against the door jamb and securing it thereto by suitable securing means indicated diagrammatically at 68, this securement means being of desired nature depending on the character of the material of the jamb, such for example as masonry, brick, steel, etc.

Figure 3:
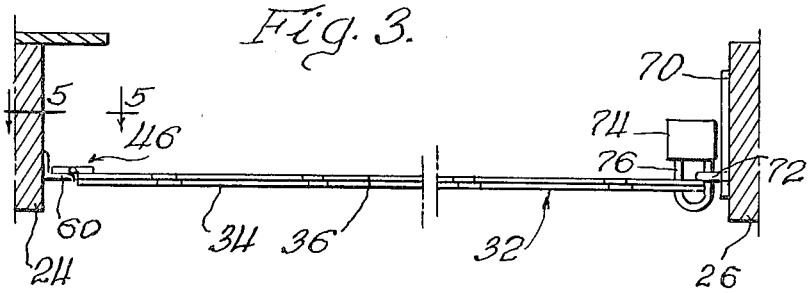
FIG. 3 is a vertical view taken at line 3—3 of FIG. 1.
Figure 4:
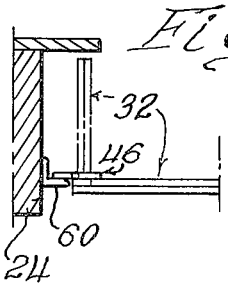
FIG. 4 is a vertical view taken at line 4—4 of FIG. 2.
Figure 5:
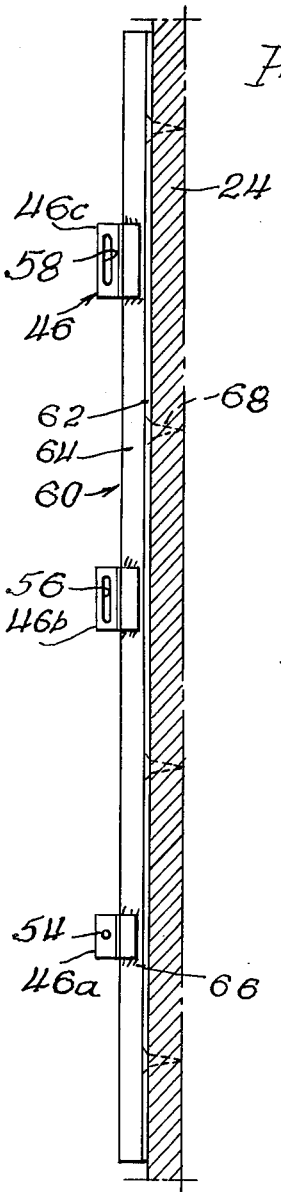
FIG. 5 is a view of the inner side of a rail utilized in mounting the gate, and the hinges of the invention secured thereto, this view being oriented according to line 5—5 of FIG. 3.
Figure 7:
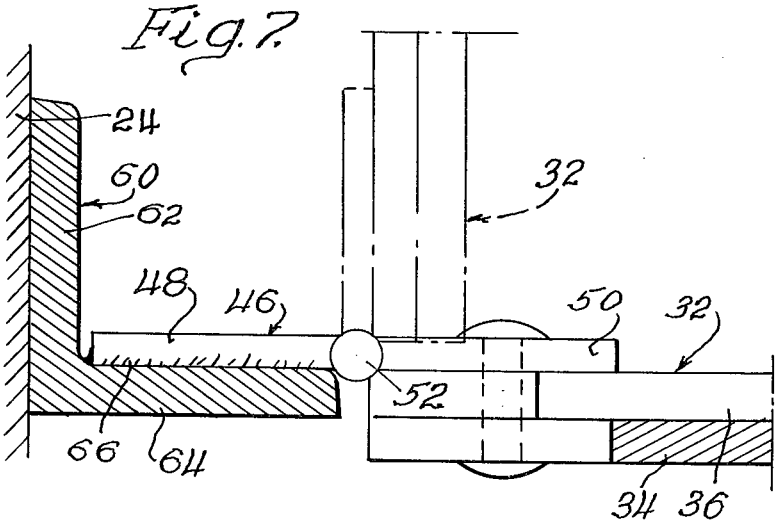
FIG. 7 is a large scale view taken at line 7—7 of FIG. 1.
Figure 8:
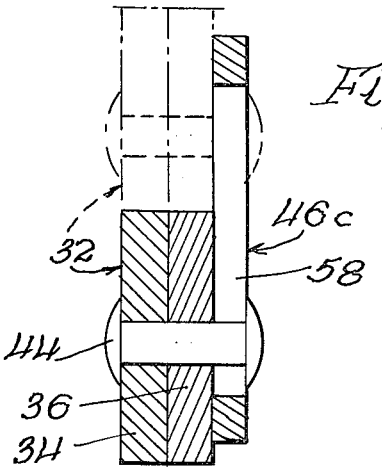
FIG. 8 is a view taken at line 8—8 of FIG. 1.

Referring again to FIGS. 1 and 3 the gate is locked in any suitable manner such as by a locking member 70 mounted on the door jamb 26 in any suitable manner. Eyelets 72 are mounted on the member 70 as by welding. Suitable locks 74 may be utilized, having for example loops 76 which are inserted through the scallops 42 and the eyelets 72. The hinges enable the web to be swung to a transverse inactive position indicated at 79 in FIGS. 4 and 7.

An important feature of the invention is the great saving in labor and material in making the gate. In folding gates previously known, there were required at the hinge edge of the gate, both a mounting bar and a gate rail. The mounting bar, which usually was in the form of an angle iron, was mounted on the door jamb, and the gate rail was secured to the web of the gate. Then hinges were welded to both the mounting bar and the gate rail. As steps in fabricating such a construction, the gate rail, which was applied to the web of the gate, was fitted to the web and then marked for the positions of the openings in the rail. The rail was then removed from its association with the web, carried to the punch press, punched, and then carried back to the web; the rivets, such as 44 herein, were then inserted through the holes in the strips of the web and the holes in the rail, and riveted. Hinges were then welded to that gate rail and the mounting bar. In the fabrication of each individual gate, accuracy was required for marking and punching or slotting the gate rail.

In the present case, in great contrast to the foregoing, a great saving in labor is achieved by fabricating a large number of each of the hinges used in the set. The hinges of one kind, i.e., 46*a*, 46*b*, or 46*c*, are fabricated in great quantity after setting the punch press and taking other steps and then all of one kind are punched in a continuing operation. Once the machine for punching is adjusted and set, all of the hinges of one kind are produced exactly the same. Thereupon, in fabricating the web, the hinges of a set, i.e., one hinge of each kind, are selected and put in place simply by inserting the rivets 44 in place as stated above. This is a very rapid operating step, and absolute accuracy is assured. After the hinges are applied to the web, the next step is to secure the hinges to the rail, by welding the leaves 48 thereto. This is also a very simple step and all the foregoing steps can be accomplished by a semi-skilled person.

In addition to the great saving of labor just referred to, another great advantage of the invention is that one of the rails, that is, the mounting bar or gate rail is eliminated, and the function of both of those are accomplished by the single rail 24 herein.

I claim:

1. In a folding gate which includes a web including a pair of sets of strips, the strips of each set lying essentially in a plane and being parallel and the sets being fitted together with the planes fitted flat together and the strips in the respective sets in mutually angular relation, the strips of the two sets being pivotally secured together at points of their intersection, the joined ends of the strips forming scallops at the ends of the web, and there being a plurality of such scallops at each end, the web being extensible and contractible longitudinally and the web decreasing and increasing in transverse direction respectively in response to its being extended and contracted, the construction comprising, means for mounting the web on a jamb of a doorway including (a) a single rail in the form of an angle iron uniform in shape throughout its length having a pair of legs thereby also extending throughout its length, the legs being at an angle to each other, one of the legs being adapted for fitting flat to and securement to an element of the jamb extending transverse to the doorway and itself thereby extending transverse to the doorway, the other leg constituting a supporting element directed in the longitudinal direction of the doorway when the rail is mounted on the jamb, and having a flat surface extending throughout the full length of the rail and also its own full extent in said longitudinal direction, that is clear and unencumbered, (b) a plurality of hinges separate from each other and each having a pair of leaves connected together by a pintle, the leaves being flat pieces, a first leaf of each pair being fitted in flat face-to-face engagement, throughout substantial area, with the flat surface of said supporting element of the rail and secured thereon by weld, the hinges being spaced apart along the length of the rail according to their points of connection with the web which are pre-determined according to the construction of the web, as stated below, the supporting element being unobstructed and uniform throughout its height except for the application of the hinges thereto, a second leaf of each pair of leaves of the hinges being pivotally connected with the web at said scallops at the end of the web, one of said second leaves of the hinges having a hole without material elongation in any direction receiving a corresponding pivoting element in the web and that hinge being thereby operable for retaining the corresponding portion of the web against movement in transverse direction, and the other said second leaves of the hinges having elongated holes receiving corresponding pivoting elements in the web and thereby enabling transverse movement of corresponding portions of the web, said hinges being of identical outline size and shape and distinguished from each other by the size and shape of the holes therein, and the elongated holes being so elongated in the direction of the pintles.

* * * * *